United States Patent [19]

Clark et al.

[11] Patent Number: 4,943,006

[45] Date of Patent: Jul. 24, 1990

[54] RAIL FASTENING MEANS

[75] Inventors: Jack Clark; Norman K. Geddes, both of Adelaide, Australia

[73] Assignee: BHP Rail Products, Inc., Melbourne, Australia

[21] Appl. No.: 752,476

[22] Filed: Jul. 3, 1985

Related U.S. Application Data

[63] Continuation of Ser. No. 398,207, Jul. 14, 1982, abandoned.

[30] Foreign Application Priority Data

Jan. 25, 1982 [AU] Australia ..... 2427

[51] Int. Cl.[5] ..... E01B 9/48

[52] U.S. Cl. ..... 238/349; 238/351

[58] Field of Search ..... 238/59, 60, 61, 84, 238/310, 338, 349, 351

[56] References Cited

U.S. PATENT DOCUMENTS

| | | | |
|---|---|---|---|
| 785,647 | 3/1905 | Willcoxen | 238/351 X |
| 1,842,407 | 1/1932 | Keech | 238/63 |
| 1,888,557 | 11/1932 | Kurkowski | 238/349 X |
| 1,926,088 | 9/1933 | Fairies et al. | 238/349 |
| 2,312,026 | 2/1943 | Cantrell et al. | 238/349 |
| 2,490,962 | 12/1949 | Heyerdahl-Larsen | 238/349 |
| 2,954,169 | 9/1960 | Rigby | 238/349 |
| 3,894,687 | 7/1975 | Jacobson | 238/351 X |
| 4,284,238 | 8/1981 | Verdef | 238/349 |

FOREIGN PATENT DOCUMENTS

| | | |
|---|---|---|
| 27624 | 6/1884 | Fed. Rep. of Germany . |
| 632714 | 7/1936 | Fed. Rep. of Germany . |
| 648369 | 7/1937 | Fed. Rep. of Germany . |
| 810277 | 8/1951 | Fed. Rep. of Germany . |
| 1228648 | 11/1966 | Fed. Rep. of Germany . |
| 3040769 | 9/1981 | Fed. Rep. of Germany . |
| 2012732 | 3/1970 | France . |
| 696418 | 9/1953 | United Kingdom . |
| 839236 | 6/1960 | United Kingdom . |
| 844720 | 8/1960 | United Kingdom . |
| 869480 | 5/1961 | United Kingdom . |
| 922658 | 4/1963 | United Kingdom . |
| 1474698 | 5/1977 | United Kingdom . |

*Primary Examiner*—Andres Kashnikow

*Attorney, Agent, or Firm*—Charles F. Duffield

[57] ABSTRACT

A sleeper having two pairs of protuberances upstanding from its upper portion, the protuberances of each pair defining between them a rail seat, apertures in the upper wall of the sleeper which extend from the protuberances for a short distance away from the rail seat, four U-shaped clips engaging each sleeper, each U-shaped clip having an upper toe, which bears downwardly on the upper portion of the rail, a heel engaging the upper surface of the sleeper adjacent the relevant aperture, and a lower toe extending through an aperture in the rail and bearing upwardly against the undersurface of a respective protuberance.

13 Claims, 2 Drawing Sheets

FIG 1
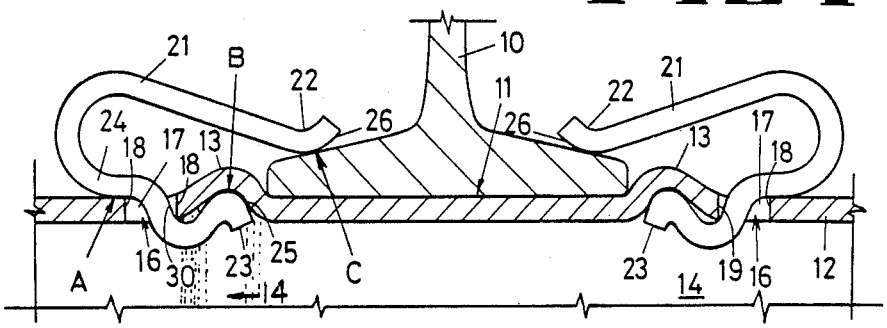
FIG 2
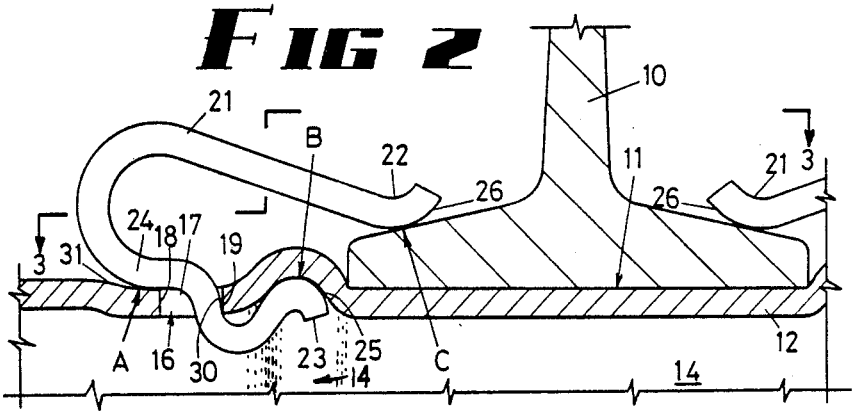
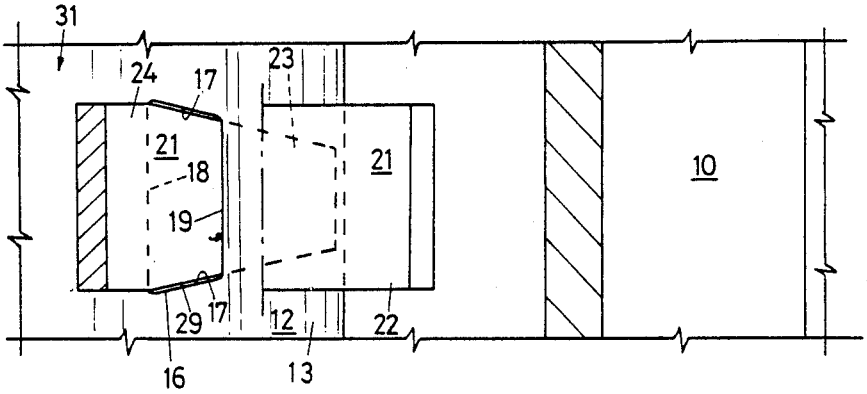
FIG 3

RAIL FASTENING MEANS

This application is a continuation of application Ser. No. 398,207 filed July 14, 1982, now abandoned.

This invention relates to a combination of a rail sleeper and fastening clip for the fastening of a rail to a sleeper. The invention is useful for all types of rails (both light and heavy).

BACKGROUND OF THE INVENTION

There is a well recognized requirement for steel rails and sleepers to be associated with an inexpensive fastening system wherein a fastener can be simply and quickly positioned or removed. Previous fastening devices have frequently required welding, the use of retention pins, dog spikes and the like, and these have generally been either unsatisfactory or expensive.

BRIEF SUMMARY OF THE INVENTION

With the object of providing an inexpensive and valuable fastening system, in one aspect of this invention there is provided a sleeper having protuberances upstanding from its upper portion, the protuberances of each pair defining between them a rail seat, apertures in the upper wall of the sleeper which extend from the protuberances for a short distance away from the rail seat, four U-shaped clips engaging each sleeper, each U-shaped clip having an upper toe which bears downwardly on the upper portion of the rail, a heel engaging the upper surface of the sleeper adjacent the relevant aperture, and a lower toe extending through an aperture in the sleeper and bearing upwardly against the under-surface of a respective protuberance.

More specifically, the invention consists of a combination of a rail sleeper and fastening clip for fastening the foot of a rail to a sleeper, comprising a sleeper having two pairs of protuberances upstanding from its upper portion, the protuberances of each pair being spaced and defining therebetween a rail seat portion of the sleeper which supports a respective said rail and retains it for gauge, a plurality of aperture forming surfaces in the upper wall of said sleeper defining apertures therethrough adjacent respective said protuberances and extending away from the rail seat portions, a corresponding plurality of 'U'-shaped clips each having an upper toe, a heel, and a lower toe, the upper toe bearing downwardly on a rail foot, the lower toe extending through a respective one of said apertures and bearing upwardly against the under-surface of the adjacent protuberance, and the heel bearing downwardly on the upper portion of the rail adjacent that said aperture.

There are many advantages with this system. Firstly it is inexpensive since it requires only working of the rail sleeper to provide the required protuberances and apertures, and forming a plurality of clips, and in some of the embodiments each clip is of constant cross-sectional shape.

Assembly is effected by simple driving of the clips towards the rail, the natural disposition of a clip before being driven being such that a hammer will strike in the right direction, and disassembly is effected by simply bearing against the rail or some other abutment and withdrawing the relevant clip.

If the protuberances extend only part way across the sleeper there is only negligible loss of strength (if any), yet each protuberance constitutes a flexing area which reduces incidence of stress concentration around the adjacent aperture.

If the walls which define the apertures have curved surfaces in the corners, there is provided a still further inhibition of stress concentration, and in any case the apertures are displaced away from the edge of the rail foot by such a distance that they avoid the most highly stressed area of the sleeper.

The surfaces which define the apertures are effective in restraining the clip against either twist or longitudinal movement.

If the aperture inner wall and a face of the clip are complementary in shape, there is an overdriving limit which reduces danger of overdriving the clip inwardly, overdriving of the clip being inhibited by abutment of the inner wall by that face of the clip.

In all embodiments there is a smaller lateral distance between the upper and lower bearing surfaces of the clip than between the clip lower bearing surface and its heel, so that most of the pressure load developed by straining the clip is applied to the rail foot, and very little ineffectual pressure load is applied to the clip heel. This results in an excellent spring rate and thus reduces both stresses and fatigue in the clip metal. Engagement of the lower toe beneath the protuberance results in a "snap action" which inhibits inadvertent clip release.

BRIEF DESCRIPTION OF THE DRAWINGS

Embodiments of the invention are described hereunder in some detail with reference to, and are illustrated in, the accompanying drawings, in which:

FIG. 1 is a fragmentary longitudinal section through a rail showing a small rail being retained against its rail seat by a resilient clip, FIG. 2 is a similar section through a larger rail, FIG. 3 is a plan section taken on line 3—3 of FIG. 2.

Figure 4:
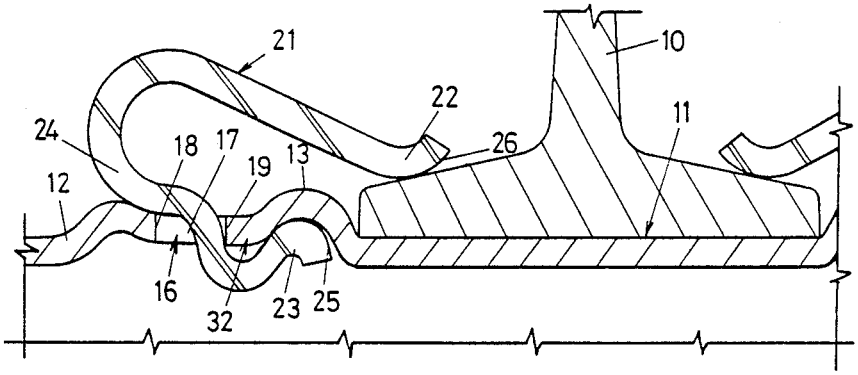
FIG. 4 illustrates a second embodiment wherein the aperture for the clip is in a sleeper portion having an increased section modulus.

In the embodiments of FIGS. 1 and 2 a rail 10 is retained against a rail seat portion 11 of a steel sleeper 12, the rail seat portion 11 being defined between two upstanding protuberances 13, the protuberances 13 however extending downwardly as side wall protuberances 14 which extend a short way down the side walls and thereby stiffen the side walls of the sleeper 12 at the locality of the rail.

Extending away from each protuberance 13 (with respect to the rail seat 11) are a pair of apertures one on each side of the rail seat 11, the apertures being designated 16, and being defined by side walls 17, an outer end wall 18, and an inner end wall 19 (with respect to the rail seat 11). The corners of the apertures are curved.

Although only two clips 21 are shown in FIG. 1 of the drawings, each sleeper has associated therewith four clips 21 which bear against opposite sides of the feet of the two rails 10. Each clip 21 is provided with an upper toe 22, a lower toe 23, and is of general 'U'-shape having a heel 24.

Figure 5:
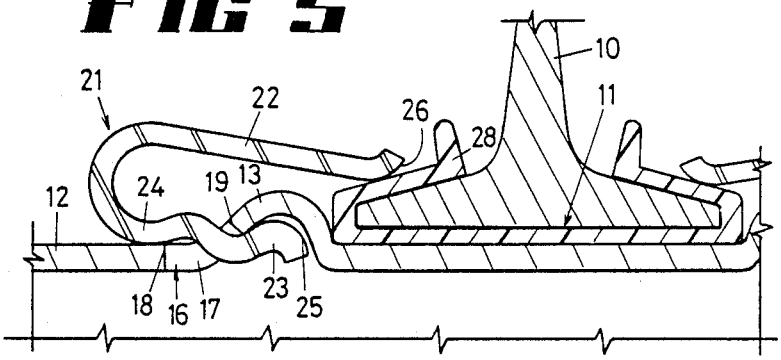
FIG. 5 is a section similar to FIGS. 1 and 2 of a "heavy haul" rail insulated from its sleeper, which is a steel sleeper.

The lower toe 23 is formed to have an upwardly convex surface which will bear upwardly against the under surface of a respective protuberance 13 when the clip is driven "home", and thereby the lower toe 23 has an inwardly and downwardly sloping cam surface 25. The inner end of the upper toe 22 is curved upwardly so that the upper toe also has a cam surface which is designated 26. The sleeper is formed by punching the upper wall to form the apertures 16 and deforming the sleeper so as to form the protuberances 13 and 14 (although this order may be reversed). When a clip is driven into position to bear against the upper surface of a rail foot, its cam surface 25 will cam under the inner wall 19 as it passes through the relevant aperture. At the same time the cam surface 26 of the upper toe 22 will cam over the upper surface of the rail foot, (or, in the case of the embodiment of FIGS. 5 and 6, the insulating pad 28) and thereby assembly is effected in an extremely easy manner. It might be noted that in FIG. 6, the toe 26 is shaped to present a large bearing area to the pad 28. Driving is facilitated, since when the clip first enters its aperture, it has an inclined disposition whereby it is aligned with the tangent of the arc of normal swing of a sledge hammer. Disassembly can be effected by hooking a tool into the hair pin shaped clip, and bearing against the protuberance or against the rail to move the clip outwardly in a transverse direction.

The arrows A, B and C in FIGS. 1 and 2 show the forces which are imparted upon the clip, and it will be seen that these forces tend to open the clip so as to increase the space defined by the legs of the clip.

In the embodiments of FIGS. 1 and 2, since the rail is a light weight rail, the sleeper 12 is of thin gauge and therefore the protuberance surfaces can be formed to lie more steeply than in the other embodiments. The steep slope of the surface 30, where it abuts the edge 19 as shown in FIG. 1, is sufficient to avoid overdriving the clip 21 such that it might become incorrectly placed, and also strained beyond its elastic limit.

In the instances illustrated in FIGS. 2 and 3, the side walls 17 defining the aperture 16 converge towards the rail, (and therefore towards the high stress zone of the sleeper) thereby (a) reducing the total aperture area and thus limiting loss of mechanical strength, (b) moving the weakness plane further away from the rail, and (c) providing additional means limiting overdrive of the clips 21. Alternatively, a rectangular aperture can be used and the width of the lower toe 23 reduced to provide abutment shoulders which will abut walls 19 to limit overdrive.

Further, in FIGS. 2 and 3, inadvertent outward movement of the clip 21 is restrained by a sloping upper surface 31 of the sleeper 10.

In the embodiment of FIG. 4, the upper wall of the sleeper 12 is formed upwardly at the locality of the aperture 16 to have a platform 32 which provides an area of greater section modulus than the rest of the sleeper, and it is in this area that the aperture 16 exists.

Figure 6:
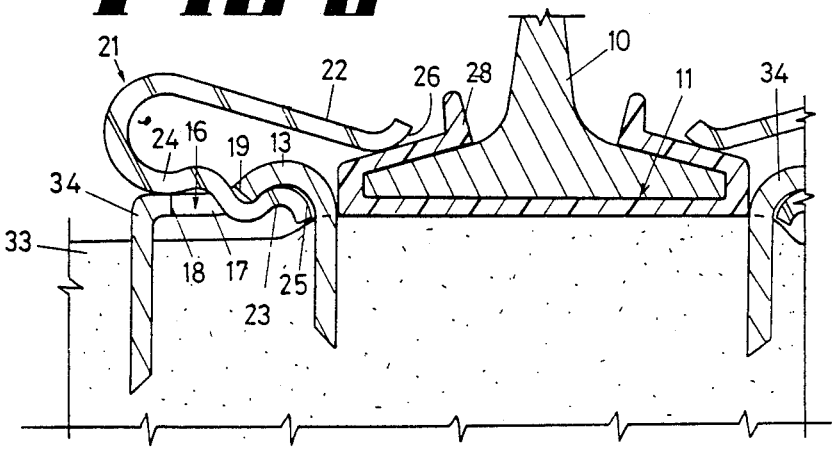
FIG. 6 is a section similar to FIGS. 1 and 2 of a "heavy haul" rail insulated from its sleeper, the sleeper having a concrete base.

In the embodiment of FIG. 6, a sleeper 33 has a concrete base and has embedded therein four shoulders 34, each of inverted 'U'-shape. Identical shoulders 34 can be embedded by different amounts for different sleepers. The under surfaces of the bridge portions of the shoulders stand clear of the concrete upper surface to provide space for the lower toe 23.

It will be noted that this invention provides the following advantages over prior art:

(1) the protuberance surfaces retain rail gauge and also retain clip location, (2) overdriving of (and consequential damage to) the clip is inhibited, (3) the heel pressure A is smaller than either bearing pressure B or C, (4) the apertures do not need to have sharp corners, with their consequential stress concentration, (5) the invention is applicable to sleepers having a concrete base as well as steel sleepers, (6) the clips are easily driven and easily removed, (7) the clips engage the sleeper very positively and with a "snap" action, (8) the apertures are located away from the most highly stressed zones of the sleeper, (9) the clips have low profile,

(10) the apertures are outboard of a zone which readily flexes.

What is claimed is:

1. A combination of a rail sleeper and fastening clip for fastening the foot of a rail to the sleeper comprising:

a sleeper having an upper and lower surface;

at least one protuberance formed in the sleeper and defining on the upper surface of the sleeper an upstanding rail seat for supporting and retaining a rail for gauge and defining on the lower surface of the sleeper a concave clip retaining recess;

at least one clip aperture formed through the sleeper adjacent to the protuberance and opposite the rail seat;

at least one fastening clip of a general U-shaped configuration having an upper toe, a heel and a lower toe and adapted to resiliently lock through the clip aperture such that the upper toe bears downwardly on the rail foot, the heel bears downwardly on the upper surface of the sleeper and the lower toe bears upwardly against the clip retaining recess; and the lower toe of the fastening clip being formed of a concave portion adjacent the heel which extends through the clip aperture and beneath the lower surface of the sleeper and terminating in a convex portion which is complementary to and bears against the clip retaining recess.

2. A combination according to claim 1 wherein the convex portion of the lower toe of the fastening clip terminates in a downwardly turned cam surface.

3. A combination according to claim 1 wherein the sleeper is formed of relatively thin gauge steel material and the protuberance is formed of generally uniform cross section.

4. A combination according to claim 1 including two protuberances arranged in a pair, the protuberances being spaced and defining therebetween a rail seat portion.

5. A combination according to claim 1 wherein the protuberance extends across the sleeper upper surface.

6. A combination according to claim 1 wherein the sleeper includes side walls and the protuberance extends across the entire width of the sleeper upper surface and part way down the sleeper side walls from the upper surface.

7. A combination according to claim 1 wherein the upper toe of the fastening clip includes a cam surface which slopes upwardly towards the end thereof.

8. A combination according to claim 1 wherein the sleeper upper surface includes a platform extending on the opposite side of the protuberance from the rail seat and containing the clip aperture, the section modulus of the sleeper being greater at the platform locality than at other localities along the sleeper.

9. A combination according to claim 1 wherein the clip aperture includes an inner end wall and wherein the concave portion of the lower toe of the fastening clip comprises a steeply sloping surface which abuts the inner end wall of the clip aperture thereby inhibiting fastening clip overdrive.

10. A combination according to claim 1 wherein the clip aperture includes side walls and wherein the side walls of the clip aperture converge towards its end adjacent the protuberance.

11. A combination according to claim 10 wherein the lower toe of the fastening clip includes converging side walls.

12. A combination according to claim 11 wherein the sleeper includes a concrete base and an upwardly extending steel shoulder on the concrete base and wherein the protuberance is formed in the steel shoulder.

13. A combination according to claim 12 wherein the steel shoulder is of inverted U-shape and has legs depending into and retained by the concrete base.

* * * * *